US007984608B2

(12) United States Patent
Roozenboom

(10) Patent No.: US 7,984,608 B2
(45) Date of Patent: Jul. 26, 2011

(54) METHOD AND SYSTEM OF DIRECTING EXHAUST GAS

(75) Inventor: Stephan Donald Roozenboom, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 944 days.

(21) Appl. No.: 11/342,630

(22) Filed: Jan. 31, 2006

(65) Prior Publication Data

US 2007/0175203 A1 Aug. 2, 2007

(51) Int. Cl.
*F01N 3/00* (2006.01)

(52) U.S. Cl. ..... 60/285; 60/274; 60/288; 60/292; 60/295; 60/297; 60/324

(58) Field of Classification Search ..... 60/274, 60/285, 287, 288, 291, 292, 295, 297, 311, 60/324, 301
See application file for complete search history.

(56) References Cited

U.S. PATENT DOCUMENTS

| | | | | |
|---|---|---|---|---|
| 3,774,136 | A | 11/1973 | Zelenka | |
| 5,384,098 | A | 1/1995 | Morikawa | |
| 5,577,383 | A | 11/1996 | Kuroda et al. | |
| 6,164,065 | A * | 12/2000 | Denari et al. | 60/284 |
| 6,233,927 | B1 * | 5/2001 | Hirota et al. | 60/297 |
| 6,422,007 | B1 | 7/2002 | Hartick | |
| 6,745,560 | B2 * | 6/2004 | Stroia et al. | 60/286 |
| 6,779,339 | B1 * | 8/2004 | Laroo et al. | 60/297 |
| 6,820,417 | B2 * | 11/2004 | May et al. | 60/297 |
| 7,040,087 | B2 * | 5/2006 | Nakatani et al. | 60/286 |
| 7,249,455 | B2 * | 7/2007 | Tumati et al. | 60/287 |
| 2005/0132696 | A1 | 6/2005 | Tumati et al. | |
| 2006/0059896 | A1 | 3/2006 | Liu et al. | |

FOREIGN PATENT DOCUMENTS

| | | |
|---|---|---|
| GB | 2 134 408 A | 8/1984 |
| JP | 59-165817 | 9/1984 |
| JP | 59-173515 | 10/1984 |
| JP | 3074513 | 8/1989 |
| JP | 5-163930 | 6/1993 |
| JP | 7-83036 | 3/1995 |
| WO | WO 01/33057 A2 | 5/2001 |
| WO | WO 03/031780 A1 | 4/2003 |

OTHER PUBLICATIONS

PCT International Search Report; PCT/US2007/001355; International Filing Date: Jan. 19, 2007; Priority Date: Jan. 31, 2006; Ap.

* cited by examiner

*Primary Examiner* — Binh Q. Tran
(74) *Attorney, Agent, or Firm* — Finnegan, Henderson, Farabow, Garrett & Dunner LLP

(57) ABSTRACT

A method of directing flow of exhaust gas includes directing a first portion of the flow through a first flow path and directing a second portion of the flow through a second flow path. A temperature of at least a portion of the flow in the first flow path is increased, and the flow in the first flow path is sent through a filter. The first and second portions of the flow downstream of the filter to are combined form a combined flow. The combined flow is maintained within a predetermined range of temperatures, and the combined flow is directed to a catalyst.

28 Claims, 3 Drawing Sheets

METHOD AND SYSTEM OF DIRECTING EXHAUST GAS

TECHNICAL FIELD

The present disclosure relates generally to a method and system of directing exhaust gas, and more particularly, to a method and system of directing exhaust gas in an aftertreatment system.

BACKGROUND

Engines, including diesel engines, gasoline engines, gaseous fuel-driven engines, and other engines known in the art, may exhaust a complex mixture of air pollutants. The air pollutants may be composed of gaseous and solid material, including particulate matter, nitrogen oxides ("NOx"), and sulfur compounds.

Due to heightened environmental concerns, exhaust emission standards have become increasingly stringent over the years. The amount of pollutants emitted from an engine may be regulated depending on the type, size, and/or class of engine. One method that has been implemented by engine manufacturers to comply with the regulation of particulate matter and NOx exhausted to the environment has been to remove these pollutants from the exhaust flow of an engine with an aftertreatment system that includes filters. However, using filters for extended periods of time may cause the pollutants to buildup in the components of the filters, thereby causing filter functionality and engine performance to decrease.

The collected particulate matter may be removed from the filter material through a process called regeneration. A particulate trap may be regenerated by increasing the temperature of the filter material and the trapped particulate matter above the combustion temperature of the particulate matter, thereby burning away the collected particulate matter. This increase in temperature may be effectuated by various means. For example, some systems may employ a heating element to directly heat one or more portions of the particulate trap (e.g., the filter material or the external housing). Other systems have been configured to heat exhaust gases upstream of the particulate trap. The heated gases then flow through the particulate trap and transfer heat to the filter material and captured particulate matter. Such systems may alter one or more engine operating parameters, such as the ratio of air to fuel in the combustion chambers, to produce exhaust gases with an elevated temperature. Alternatively, such systems may heat the exhaust gases upstream of the particulate trap with, for example, a burner disposed within an exhaust conduit leading to the particulate trap.

One method of regenerating a diesel engine exhaust filter is described in U.K. Patent Application Publication No. GB 2 134 408 A ("the '408 publication") to Wade et al. The method for regenerating the exhaust filter described in the '408 publication includes bypassing all of the exhaust gas around the filter through a duct, supplying combustible gas to the filter at a low flow rate, and raising the temperature of the combustible gas to ignite the filter. When the temperature of the heated combustible gas leaving the filter exceeds a predetermined limit, the regeneration process is completed and the exhaust gas is allowed to flow through the filter again.

Although the system of the '408 publication includes a particulate trap for capturing particulate matter, all of the exhaust gas is directed to bypass the filter when the filter is being regenerated. Therefore, none of the particulate matter is removed from the exhaust gas during the regeneration process.

Also, although the particulate trap of the '408 publication may be able to remove particulate matter from the exhaust gas, the trap does not remove other types of pollutants in the exhaust gas, such as NOx emissions and sulfur compounds.

Furthermore, the heated gases that flow toward the particulate trap may damage any temperature-sensitive components downstream from the particulate trap. Components that may be damaged or less efficient at high temperatures include some catalysts for removing pollutants from the exhaust gas by chemical reaction. Components that are made to withstand higher temperatures, such as the temperatures required for regeneration, are typically more expensive.

The disclosed system and method are directed to overcoming one or more of the problems set forth above.

SUMMARY OF THE INVENTION

In one aspect, the present disclosure is directed to a method of directing flow of exhaust gas. The method includes directing a first portion of the flow through a first flow path and directing a second portion of the flow through a second flow path. A temperature of at least a portion of the flow in the first flow path is increased, and the flow in the first flow path is sent through a filter. The first and second portions of the flow downstream of the filter to are combined form a combined flow. The combined flow is maintained within a predetermined range of temperatures, and the combined flow is directed to a catalyst.

In another aspect, the present disclosure is directed to an aftertreatment system including first and second flow paths. Each of the flow paths receive a separate portion of a flow. The aftertreatment system also includes a filter and a regeneration device positioned in the first flow path. The regeneration device is fluidly connected to an inlet of the filter and configured to increase a temperature of at least a portion of the flow in the first flow path. The first and second flow paths are combined downstream from the filter and the regeneration device to form a combined flow. The aftertreatment system also includes a catalyst positioned downstream from where the first and second flow paths combine, and a controller configured to maintain the combined flow within a predetermined range of temperatures.

In another aspect, the present disclosure is directed to a method of directing flow of exhaust gas. The method includes directing a first portion of the flow through a first flow path and directing a second portion of the flow through a second flow path. A temperature of at least a portion of the flow in the first flow path is increased, and the flow in the first flow path is sent through a filter. An amount of flow directed through the second flow path is controlled when increasing the temperature of the at least a portion of the flow in the first flow path. The first and second portions of the flow downstream of the filter are combined to form a combined flow, and the combined flow is directed to a NOx-reducing catalyst.

DETAILED DESCRIPTION

Figure 1:
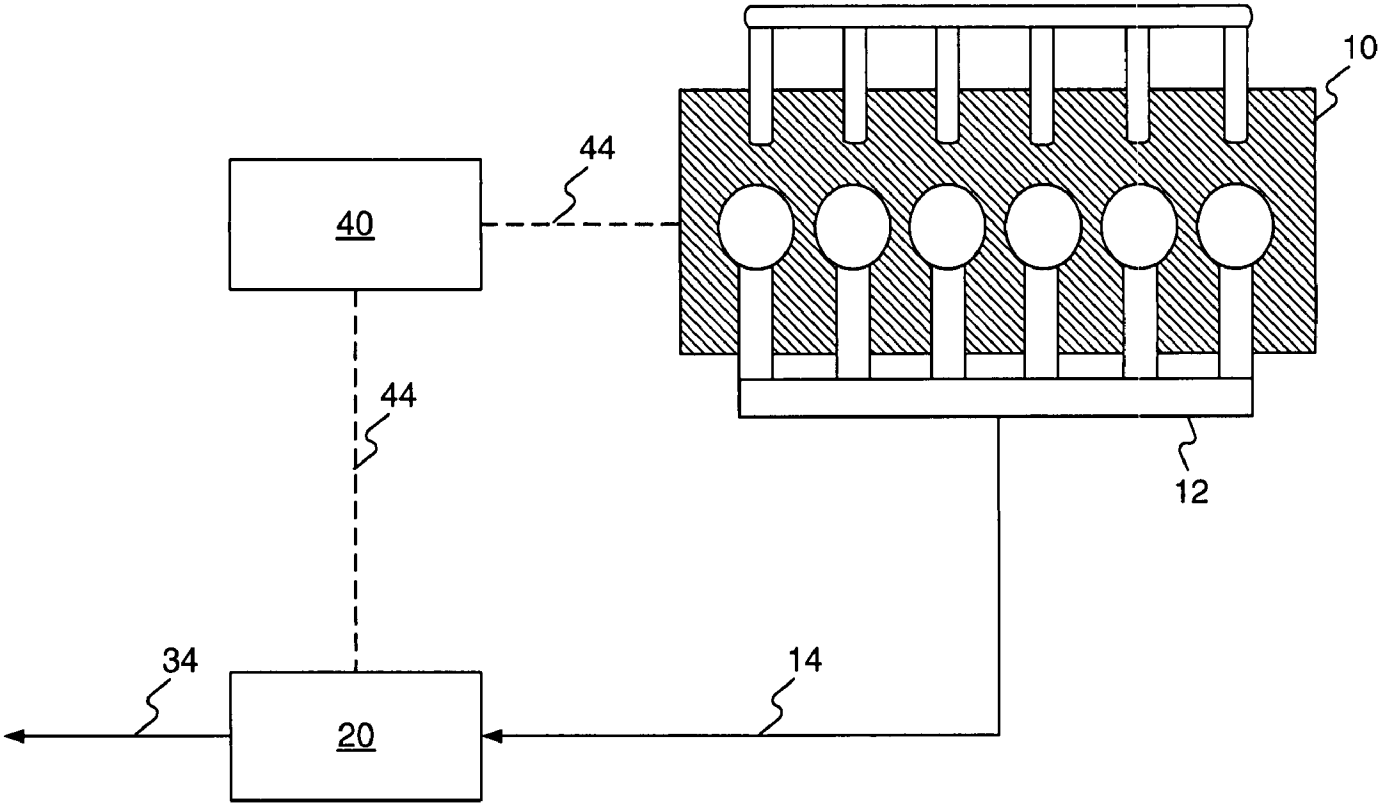
FIG. 1 is a diagrammatic illustration of an exemplary disclosed engine with an aftertreatment system.

FIG. 1 illustrates an internal combustion engine 10, such as, for example, a diesel engine, a gasoline engine, a gaseous fuel-powered engine, or any other engine apparent to one skilled in the art, with an exemplary embodiment of an aftertreatment system 20. The engine 10 may include an exhaust manifold 12 connecting an exhaust flow from the engine 10 with an inlet of the aftertreatment system 20 via an input flow line 14. The engine 10 may alternatively be another source of power such as a furnace or any other suitable source of power for a powered system such as a factory or power plant.

The engine 10 and the aftertreatment system 20 are connected to a controller 40. Alternatively, the controller 40 may be integrated into the engine 10. The controller 40 is capable of transmitting signals to the aftertreatment system 20, as described below. The controller 40 may be, for example, an electronic control module ("ECM"), a central processing unit, a personal computer, a laptop computer, or any other control device known in the art. The controller 40 may receive input from a variety of sources including, for example, a temperature sensor 42 (described in greater detail below with respect to FIG. 2) and engine sensors (not shown), e.g., sensors configured to measure temperature, speed, fuel quantity consumed, and/or other operating characteristics of the engine 10. The controller 40 may use these inputs to form a control signal based on a pre-set control algorithm. The control signal may be transmitted from the controller 40 to various actuation devices (described in greater detail below) across communication lines 44, which are shown as dashed lines in FIGS. 1 and 2.

Figure 2:
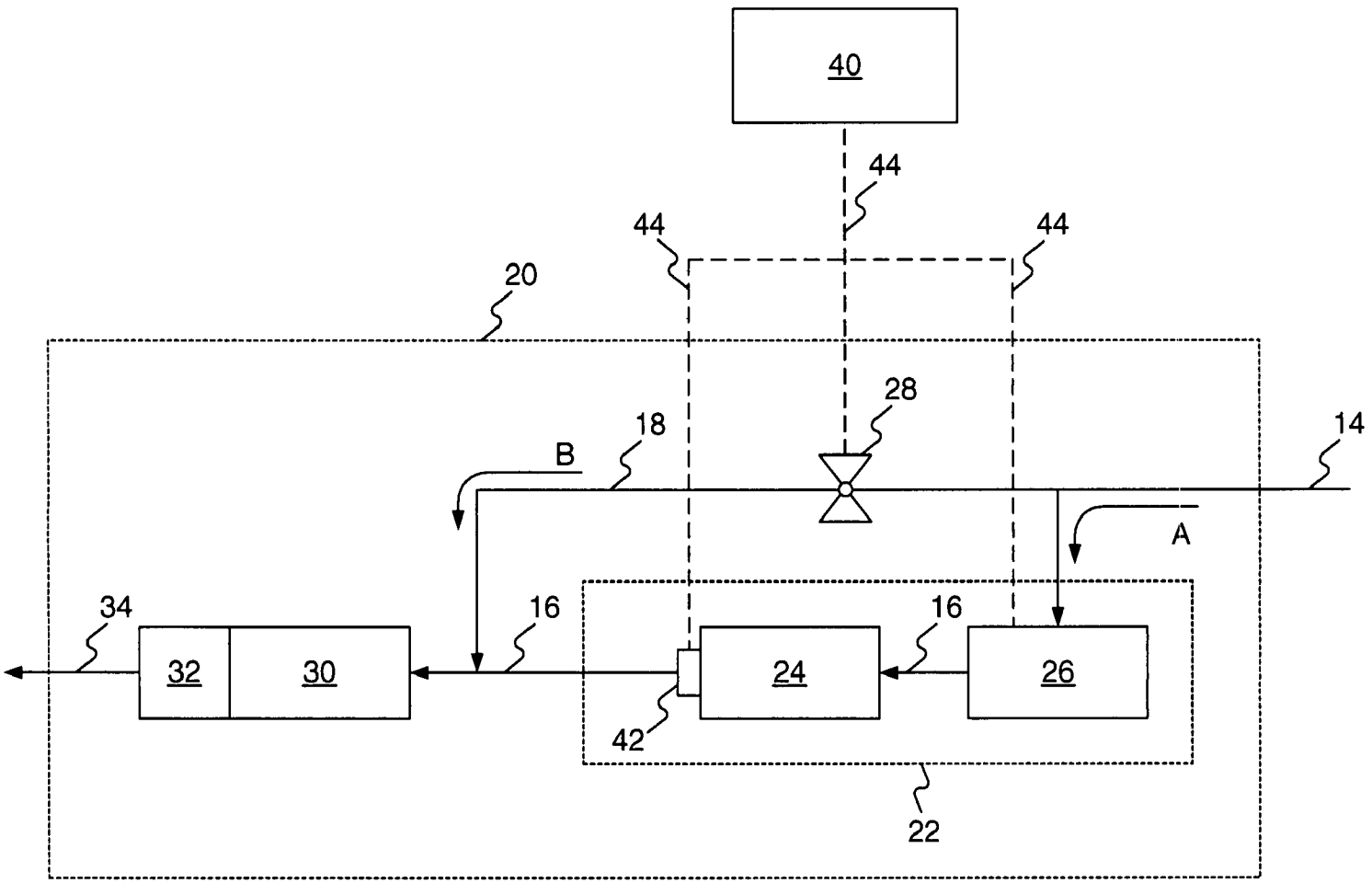
FIG. 2 is a diagrammatic illustration of an exemplary disclosed aftertreatment system.

FIG. 2 illustrates the aftertreatment system 20. The aftertreatment system 20 removes pollutants from the exhaust gas. The exhaust gas is divided so that a first portion follows a first path (arrow A) and a second portion follows a second path (arrow B). The aftertreatment system 20 may include a filter system 22 that receives, via a first flow line 16 that follows the first path (arrow A), at least a portion of the flow of exhaust gas that is received from the exhaust manifold 12 of the engine 10.

The filter system 22 captures particulates, ash, or other materials from an exhaust flow to prevent their discharge from the aftertreatment system 20 into the surrounding environment. The filter system 22 may include a filter 24, such as a diesel particulate filter (DPF) or other type of device that physically captures particulates, ash, or other materials from the exhaust gas.

The filter system 22 may also include a regeneration device 26 located upstream from the filter 24. In the exemplary embodiment, an auxiliary regeneration device (ARD) is used to regenerate the filter system 22. Regeneration involves removing the collected particulates from the filter 24 by exposing the filter 24 to high temperatures. The high temperatures cause the particulates to burn off of the filter 24. For example, according to one exemplary embodiment, the filter 24 may be exposed to temperatures of approximately 600-700° C. Alternatively, instead of, or in addition to, directly exposing the filter 24 to high temperatures, the exhaust gas upstream from the filter 24 may be heated to high temperatures, which exposes the filter 24 to the high temperatures indirectly.

The regeneration device 26 may be a device that is used in active regeneration. As used herein, the term "active regeneration" refers to using a regeneration device or some other heat source to initiate the burning and/or combustion of, e.g., soot contained within a filter.

The regeneration device 26 may include, for example, a fuel injector and an igniter (not shown), heat coils (not shown), a fuel-powered burner (not shown), an electrically-resistive heater (not shown), an engine control strategy, and/or other heat sources known in the art. Such heat sources may be disposed within the regeneration device 26 and may be configured to assist in increasing the temperature of the flow of exhaust gas through convection, combustion, and/or other methods. The regeneration device 26 may receive a supply of a combustible substance and a supply of oxygen to facilitate combustion within the regeneration device 26. The combustible substance may be, for example, gasoline, diesel fuel, reformate, and/or any other combustible substance known in the art. A supply of oxygen may be provided in addition to the relatively low pressure flow of exhaust gas directed to the regeneration device 26 through the first flow line 16.

The high temperatures are achieved using the regeneration device 26. The regeneration device 26 burns fuel to increase the temperature of the filter 24 or of the exhaust gas upstream of the filter 24, thereby sending high temperature exhaust gas to the filter 24 through the first flow line 16 to burn off the particulates in the filter 24. As a result, the exhaust gas that leaves the filter 24 is at a high temperature.

Thus, the first portion of the exhaust gas passes through the filter system 20 via the first flow line 16 and is heated during the regeneration process by the regeneration device 26. The second portion of the exhaust gas flows through a second flow line 18 that follows the second path (arrow B) and bypasses the filter system 22 and the regeneration device 26.

A valve 28 of the aftertreatment system 20 is positioned in the second path (the second flow line 18). The valve 28 may be actuated or otherwise controlled by, for example, a solenoid or other actuation device known in the art (not shown).

The valve 28 is typically closed. However, the valve 28 may be actuated to open during the regeneration process. The valve 28 and the regeneration device 26 are capable of receiving control signals from the controller 40 via the communication lines 44. For example, the controller 40 may send signals to actuate the valve 28 and to activate the regeneration device 26 via the communication lines 44.

The temperature sensor 42 may be provided downstream from the filter 22. The temperature sensor 42 measures the temperature of the exhaust gas downstream from the filter system 22 and sends a signal indicating the measured temperature to the controller 40 via the communication line 44.

The controller 40 may determine how much of the exhaust gas to send through the valve 28 (the second portion of the exhaust gas). The exhaust gas that is not sent through the valve 28 (the first portion of the exhaust gas) is then sent to the filter system 22.

Downstream from the filter system 22 and the valve 28, the first and second portions of the exhaust gas mix together before being directed to a catalyst 30, which is also included in the aftertreatment system 20. The catalyst 30 is positioned downstream from the filter 24 and the valve 28 along the direction of flow of the exhaust gas.

As shown in FIG. 2, the temperature sensor 42 may be provided near the outlet of the filter 24. The temperature sensor 42 may be positioned close to an aftertreatment device for which a temperature is controlled. For example, in the exemplary embodiment, the temperature of the catalyst 30 is being controlled. Therefore, in this embodiment, the temperature sensor 42 may also be provided closer to the catalyst 30.

According to an exemplary embodiment, the catalyst 30 is a selective catalytic reduction (SCR) catalyst that removes pollutants such as NOx from the exhaust gas by chemical reaction. The SCR catalyst provides a catalytic reduction of NOx in the exhaust gas using ammonia or urea.

Optionally, another catalyst 32, for example, a cleanup catalyst such as a selective catalytic oxidation (SCO) catalyst may be included downstream from the first catalyst 30 to remove other pollutants from the exhaust gas.

After being treated by the catalyst(s) 30, 32, the exhaust gas flows through an output flow line 34 and is output from the aftertreatment system 20.

Figure 3:
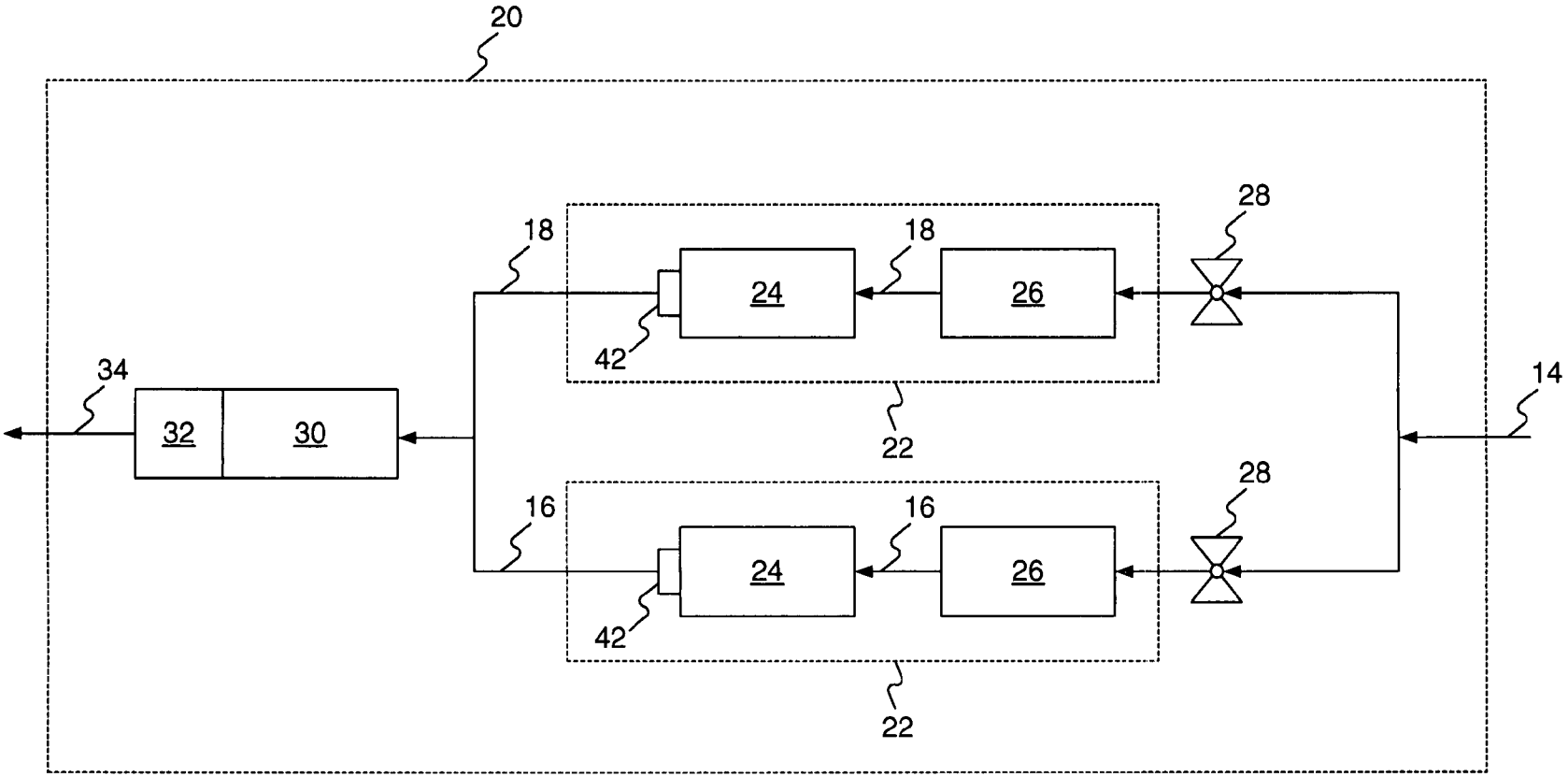
FIG. 3 is a diagrammatic illustration of another exemplary disclosed aftertreatment system.

FIG. 3 illustrates an alternate exemplary embodiment in which a second filter 24 and a second regeneration device 26 are disposed in the second flow line 18 downstream from the valve 28. The filters and regeneration devices in this alternate embodiment are in a parallel configuration. A second valve 28 may also be positioned in the second flow line 18, and a second temperature sensor 42 may be positioned near the outlet of the second filter 24.

INDUSTRIAL APPLICABILITY

The disclosed method and system of directing the flow of exhaust gas may be applicable to any powered system that includes a power source that produces exhaust gas. The disclosed method and system of directing the flow of exhaust gas allows the temperature of the exhaust gas that flows through the filter 24 and catalyst 30 to be controlled separately. As a result, the temperature of the exhaust gas flowing through the filter 24 may be kept high while the temperature of the exhaust gas flowing to the catalyst 30 may be at a lower temperature. The operation of method and system of directing the flow of exhaust gas will now be explained.

During normal operating conditions, the regeneration device 26 is inactive so that the filter 24 does not regenerate, and the valve 28 is closed. All of the exhaust gas is directed through the filter system 20 via the input flow line 14, the first flow line 16 (in the direction of arrow A), and the output flow line 34. The exhaust gas passing through the filter system 20 is not heated using the regeneration device 26.

The control algorithm programmed in the controller 40 may be used to determine when to begin regenerating the filter 24, e.g., based on an input from the engine 10 or engine sensor (not shown) or based on a predetermined time interval.

To begin the regeneration process, the controller 40 may send control signals through the communication lines 44 to actuate the valve 28 and the regeneration device 26, respectively. The control signal transmitted to the valve 28 may also include information for controlling the flow of the exhaust gas through the valve 28, such as the amount of exhaust gas permitted to pass through the valve 28.

Normally, the valve 28 is in a closed state, which forces the entire engine exhaust to flow through the filter system 22 in the first flow line 16. When the valve 28 is actuated, the valve 28 opens and the exhaust gas is able to flow down two paths after exiting the exhaust manifold 12 of the engine 10. As shown in FIG. 2, a first portion of the exhaust gas follows a first path (arrow A) and a second portion of the exhaust gas follows a second path (arrow B).

The valve 28 receives the control signal from the controller 40 to open at approximately the same time as the beginning of the regeneration process. For example, the controller 40 may send the actuation signal to the valve 28 at approximately the same time as when the controller 40 sends the actuation signal to the regeneration device 26 to begin regenerating, i.e., applying heat to, the filter 24. The controller 40 sends these command signals to the regeneration device 26 and to the valve 28 through the communication lines 44, as shown by the dashed lines in FIG. 2.

The valve 28 is positioned in the second path to control the amount of flow directed through the second flow line 18. The portion of the exhaust gas that is directed along the second flow line 18 (in the direction of arrow B in FIG. 2) bypasses the filter system 22 and the regeneration device 26. Therefore, this portion is not heated by the regeneration device 26 to the high temperatures that are necessary for regenerating the filter 24.

The remaining portion of the flow is directed toward the first path (first flow line 16) toward the regeneration device 26, which heats the gas during the regeneration process, and then to the filter system 22. During regeneration, the heated first portion of the exhaust gas and the unheated second portion of the exhaust gas combine before reaching the catalysts 30, 32. As a result, this combined flow of exhaust gas has an overall lower temperature than the temperature of the exhaust gas reached during regeneration.

When the controller 40 has determined that the regeneration process is complete, the controller 40 may send control signals to the valve 28 to close the valve 28 and to the regeneration device 26 to stop the regeneration process.

The information included in the control signals to open and/or close the valve 28 is determined using the control algorithm programmed in the controller 40. For example, the amount of exhaust gas to send through the valve 28 (the second portion of the exhaust gas) through the second flow line 18 may be a constant pre-set amount or may be determined using a closed-loop process.

If the amount of the portion of the exhaust gas flowing through the valve is a constant pre-set amount, then the valve 28 continuously allows the same amount of exhaust gas to pass until receiving a control signal from the controller 40 to stop allowing exhaust gas to flow through the valve 28.

However, if the amount of the portion of the exhaust gas flowing through the valve 28 is determined using a closed-loop process, then the valve 28 may receive signals from the controller 40 at regular time intervals or whenever the controller 40 has determined that the flow rate should be changed.

For example, after sending the actuation signals to the valve 28 and the regeneration device 26, the controller 40 may receive measurements of the temperature of the exhaust gas downstream of the filter system 22 using the temperature sensor 42.

If a measured temperature (T) is equal to or above a threshold temperature (Tth), i.e., $T \geqq Tth$, then the controller 40 may send a control signal to the valve 28 to increase incrementally the quantity of exhaust gas that is allowed to pass through the valve 28. More exhaust gas bypasses the filter system 22 and less exhaust gas is heated to regenerate the filter 24. As a result, the temperature of the combined flow of the heated and unheated portions of the exhaust gas decreases.

However, if the measured temperature is below the threshold temperature, i.e., $T<Tth$, then the controller 40 may send a control signal to the valve 28 to decrease the quantity of exhaust gas that is allowed to pass through the valve 28. Less exhaust gas bypasses the filter system 22 and more exhaust gas is heated to regenerate the filter 24. As a result, the temperature of the combined flow of the heated and unheated portions of the exhaust gas increases.

Alternatively, instead of changing the amount of flow through the valve 28 when $T<Tth$, the controller 40 may control the valve 28, e.g., by using a signal or by absence of a signal, to keep the quantity of exhaust gas passing through the valve 28 the same.

The controller 40 may monitor the measured temperature (T) and send control signals to the valve 28 at regular intervals and/or whenever the measured temperature (T) exceeds the threshold temperature (Tth). In an exemplary embodiment, the threshold temperature may be approximately 600° C., for example, when a catalyst that works less efficiently or that may be damaged at temperatures above 600° C. is provided downstream from where the heated and unheated portions of the exhaust gas combine. However, the threshold temperature may be higher or lower depending on the aftertreatment device(s) provided and the temperatures needed to maintain optimal efficiency of the provided aftertreatment device(s).

To determine how to apportion the flow of exhaust gas between the first flow line 16 and the second flow line 18, the control algorithm used by the controller 40 may also take into account other variables besides the measured temperature. For example, the flow may be apportioned between the flow lines 16, 18 to strike a balance between having enough flow through the second flow line 18 to maintain an appropriate temperature of the exhaust gas directed to the catalyst 30 and enough flow through the first flow line 16 to remove the particulate matter from the exhaust flow. When there is a large amount of exhaust gas apportioned to the first flow line 16 and a small amount of exhaust gas apportioned to the second flow line 18, more particulate matter may be removed from the exhaust flow, but the total exhaust gas directed to the catalyst 30 is at a higher temperature. This may risk damaging the catalyst 30 or causing the catalyst 30 work less efficiently. On the other hand, when there is a large amount of exhaust gas apportioned to the second flow line 18 and a small amount of exhaust gas apportioned to the first flow line 16, the total exhaust gas directed to the catalyst 30 is at a lower temperature, thereby allowing the catalyst 30 to operate efficiently if the catalyst 30 is sensitive to higher temperatures. However, when there is a small amount of flow through the filter system 22, less particulate matter may be removed from the exhaust flow, and more particulate matter may pass through the valve 28 unfiltered.

The control algorithm may be programmed to allow a minimal amount of exhaust gas through the valve 28, i.e., to minimize the second portion of exhaust gas, because the second portion of exhaust gas is not filtered by the filter system 22. The amount of exhaust gas permitted to pass through the valve 28 may be controlled so that the amount is sufficient to maintain the temperature of the combined exhaust gas directed to the catalyst 30 at a threshold temperature or slightly below it.

The control algorithm may also be programmed to ensure that an optimal amount of exhaust gas is sent through the filter system 22 to regenerate the filter 24. The optimal amount of exhaust gas to regenerate the filter 24 is determined based on several variables, e.g., the flow rate of the exhaust gas from the exhaust manifold 12, the size of the filter 24, the type of the engine 10, and what the engine 10 is doing during regeneration. As a result, the control algorithm used by the controller 40 may also take into account these variables in determining how to apportion the flow of exhaust gas between the first flow line 16 and the second flow line 18.

As a result, the temperature of the exhaust gas flowing through the filter 24 during regeneration may be kept high while the temperature of the combined exhaust gas flowing to the catalyst 30 may be lower. As a result, catalysts and other aftertreatment components may be provided that are made of less expensive materials. Special materials that can withstand the high temperatures during regeneration are no longer required to construct the aftertreatment components downstream from where the unheated and heated portions of the exhaust gas combine. Catalysts 30, 32 that may be sensitive to the high temperatures typically required for regeneration may be used, e.g., vanadia-based SCR catalysts. For example, if the filter 24 is exposed to temperatures of approximately 600-700° C., then catalysts 30, 32 made of materials that may be less efficient at temperatures above approximately 600° C. may be used while maintaining high efficiency of the aftertreatment system 20. The catalysts 30, 32 are less likely to be damaged because they are not exposed to the high temperatures required for regeneration.

Since a portion of the exhaust gas bypasses the filter system 22 during the regeneration process, less exhaust gas is sent through the filter system 22. Less energy is required for heating the exhaust gas to regenerate the filter 24. As a result, less fuel is necessary for the regeneration process.

As shown in FIG. 3, another filter 24, regeneration device 26, temperature sensor 42, and optionally, valve 28 may also be disposed in the second flow line 18. In this exemplary embodiment, the operation of these additional components in the second flow line 18 may be the same as for the like components in the first flow line 16. The portion of the exhaust gas that is directed along the second flow line 18 is filtered using the filter system 22 in the second flow line 18. As a result, the entire flow of exhaust gas that is supplied through the input flow line 14 is filtered using the two filter systems 22. In addition, both filters 24 may be regenerated separately using the corresponding regeneration devices 26. The controller 40 may control the operation of the regeneration devices 26 in the separate flow lines 16, 18 to ensure that unheated exhaust gas flows through at least one of the flow lines 16, 18 when the regeneration device 26 is operating in the other flow line. Therefore, no more than one regeneration device 26 may operate at a time. As a result, temperature control of the combined flow of exhaust gas may still be achieved while ensuring that particulates are filtered from the exhaust gas flowing through both flow lines 16, 18 even during regeneration of one of the filters 24.

The aftertreatment system 20 described in the exemplary embodiments may remove particulate matter and other types of pollutants, such as NOx emissions. The particulate matter and other pollutants may be removed continuously, such as during the regeneration process.

It will be apparent to those skilled in the art that various modifications and variations can be made to the disclosed method and system of directing flow of exhaust gas. Other embodiments will be apparent to those skilled in the art from consideration of the specification and practice of the disclosed method and system. It is intended that the specification and examples be considered as exemplary only, with a true scope being indicated by the following claims and their equivalents.

What is claimed is:

1. A method of directing a flow of exhaust, comprising:

directing a first portion of the flow of exhaust through a first flow path;

directing a second portion of the flow of exhaust through a second flow path;

increasing a temperature of at least a portion of the flow in the first flow path;

sending the flow in the first flow path through a filter;

combining the first and second portions of the flow downstream of the filter to form a combined flow;

maintaining the combined flow within a predetermined range of temperatures; and directing the combined flow to a catalyst.

2. The method of claim 1, wherein maintaining the combined flow within the predetermined range of temperatures includes controlling an amount of flow directed through at least one of the first and second flow paths.

3. The method of claim 2, wherein controlling the amount of flow directed through at least one of the first and second flow paths includes controlling the amount of flow directed through the second flow path when increasing the temperature of the at least a portion of the flow in the first flow path.

4. The method of claim 2, wherein controlling the amount of flow directed through at least one of the first and second flow paths includes:

comparing a sensed temperature of the combined flow to the predetermined range of temperatures, and changing the amount of the flow directed through the second flow path in response to the comparison.

5. The method of claim 1, wherein the predetermined range of temperatures includes temperatures less than 600° C.

6. The method of claim 1, wherein the catalyst is a NOx-reducing catalyst.

7. The method of claim 1, wherein the temperature of the at least a portion of the flow in the first flow path increases to a temperature for regenerating the filter.

8. The method of claim 1, further including sending the flow in the second flow path through a second filter.

9. The method of claim 8, further including:

stopping the increase of the temperature of the portion of the flow in the first flow path; and increasing a temperature of at least a portion of the flow in the second flow path.

10. An aftertreatment system comprising:

first and second flow paths, each of the flow paths receiving a separate portion of a flow of exhaust;

a filter and a regeneration device positioned in the first flow path, the regeneration device being fluidly connected to an inlet of the filter and configured to increase a temperature of at least a portion of the flow in the first flow path, the first and second flow paths being combined downstream from the filter and the regeneration device to form a combined flow path;

a catalyst positioned downstream from where the first and second flow paths combine; and a controller configured to maintain a combined flow of exhaust in the combined flow path within a predetermined range of temperatures.

11. The aftertreatment system of claim 10, further including at least one valve connected to the controller, the at least one valve being configured to control an amount of flow in the second flow path.

12. The aftertreatment system of claim 10, wherein the controller is in communication with the at least one valve and the regeneration device, and the controller is configured to open the at least one valve during activation of the regeneration device.

13. The aftertreatment system of claim 10, wherein the controller is configured to compare a sensed temperature of the combined flow of exhaust to the predetermined range of temperatures and to change the amount of the flow passing through the at least one valve in response to the comparison.

14. The aftertreatment system of claim 10, wherein the predetermined range of temperatures includes temperatures less than 600° C.

15. The aftertreatment system of claim 10, wherein the catalyst is a NOx-reducing catalyst.

16. The aftertreatment system of claim 10, wherein the flow is an exhaust flow from an internal combustion engine.

17. The aftertreatment system of claim 10, wherein the regeneration device includes a fuel injector and igniter.

18. The aftertreatment system of claim 10, further including a second filter and a second regeneration device positioned in the second path, the second regeneration device being fluidly connected to an inlet of the second filter and configured to increase a temperature of at least a portion of the flow in the second flow path.

19. A method of directing a flow of exhaust, comprising:

directing a first portion of the flow of exhaust through a first flow path;

directing a second portion of the flow of exhaust through a second flow path;

increasing a temperature of at least a portion of the flow in the first flow path;

sending the flow in the first flow path through a filter;

combining the first and second portions of the flow downstream of the filter to form a combined flow;

controlling an amount of flow directed through the second flow path to maintain the combined flow within a predetermined range of temperatures when increasing the temperature of the at least a portion of the flow in the first flow path; and directing the combined flow to a NOx-reducing catalyst.

20. The method of claim 19, further including maintaining the combined flow within a predetermined range of temperatures.

21. The method of claim 19, wherein controlling the amount of flow directed through the second flow path includes controlling at least one valve disposed in at least one of the first and second flow paths to maintain the combined flow within the predetermined range of temperatures when increasing the temperature of the at least a portion of the flow in the first flow path.

22. The method of claim 1, wherein maintaining the combined flow within the predetermined range of temperatures includes controlling a temperature of the combined flow to maintain the combined flow within the predetermined range of temperatures.

23. The method of claim 2, wherein controlling the amount of flow through at least one of the first and second flow paths includes:

controlling at least one valve disposed in at least one of the first and second flow paths to maintain the combined flow within the predetermined range of temperatures.

24. The method of claim 23, wherein controlling the at least one valve includes:

controlling a first valve disposed in the first flow path; and controlling a second valve disposed in the second flow path, the first and second valves being controlled to maintain the combined flow within the predetermined range of temperatures.

25. The method of claim 24, wherein controlling the first and second valves includes:

comparing a sensed temperature of the combined flow to the predetermined range of temperatures; and changing the amount of the flow directed through the first flow path and the second flow path in response to the comparison.

26. The method of claim 4, wherein changing the amount of the flow directed through the second flow path includes:

increasing the amount of flow directed through the second flow path in response to a determination that the sensed temperature is greater than a threshold temperature; and decreasing the amount of flow directed through the second flow path in response to a determination that the sensed temperature is less than the threshold temperature.

27. The aftertreatment system of claim 10, wherein the controller is configured to control an amount of flow through at least one of the first and second flow paths to maintain the combined flow of exhaust within the predetermined range of temperatures.

28. The method of claim 21 wherein controlling the at least one valve includes:

comparing a sensed temperature of the combined flow to the predetermined range of temperatures, and changing the amount of the flow directed through at least one of the first and second flow paths in response to the comparison.

* * * * *